US005669682A

United States Patent [19]

Janson

[11] Patent Number: 5,669,682

[45] Date of Patent: Sep. 23, 1997

[54] MECHANICAL AUTOMATIC AISLE LOCK

[75] Inventor: Steven L. Janson, Deerfield, Wis.

[73] Assignee: Spacesaver Corporation, Fort Atkinson, Wis.

[21] Appl. No.: 756,055

[22] Filed: Nov. 26, 1996

Related U.S. Application Data

[63] Continuation of Ser. No. 375,935, Jan. 20, 1995, abandoned.

[51] Int. Cl.[6] ..... A47B 53/02

[52] U.S. Cl. ..... 312/201; 192/44; 188/82.84

[58] Field of Search ..... 312/201, 198; 192/44, 47, 79, 45, 20; 188/82.84; 74/411.5

[56] References Cited

U.S. PATENT DOCUMENTS

| | | | |
|---|---|---|---|
| 5,160,189 | 11/1992 | Johnston et al. | 312/201 |
| 5,182,959 | 2/1993 | Chern et al. | 74/411.5 |
| 5,360,262 | 11/1994 | Davidian | 312/201 |
| 5,401,090 | 3/1995 | Fay | 312/201 |

*Primary Examiner*—Peter M. Cuomo
*Assistant Examiner*—Anthony D. Barfield
*Attorney, Agent, or Firm*—Ryan, Maki, Mann & Hohenfeldt

[57] ABSTRACT

A mechanism that automatically locks a movable storage unit against closure of an aisle between the unit and a blocking object such as a facing movable or stationary storage unit or a wall, while permitting continued opening of the aisle, without any electrical controls or power. A binding device is shiftable between a binding state permitting movement of the movable storage unit only away from the facing storage unit or wall, and a non-binding state permitting movement of the unit in either direction. The mechanism includes a clutch wheel which rotates with the wheels of the movable storage unit, and a resilient binding wheel, insertable between the clutch wheel and a stationary binding block. When the binding wheel is inserted as described, it will bind and preclude the clutch wheel from continuing to rotate towards the binding block. A latch is capable of holding the binding wheel out of binding state. An aisle sensor and a manual lock button are provided to free the binding wheel from the latch, and again permit it to resume binding state. An unlock button is also provided for resetting the binding wheel to the non-binding state, again permitting movement of the mobile storage unit toward the facing storage unit or wall.

16 Claims, 5 Drawing Sheets

MECHANICAL AUTOMATIC AISLE LOCK

This is a continuation of application Ser. No. 08/375,935 filed on Jan. 20, 1995, now abandoned.

BACKGROUND OF THE INVENTION

This invention relates to mobile storage units, particularly those units moved by hand, that is, without the aid of electric motors or other power sources, and most particularly to those mobile storage units that have some type of locking means to prevent or at least reduce the incidence of accidental closure of an aisle.

It is well known to equip mobile filing and storage systems with locking mechanisms. The disadvantage of early locking mechanisms, though, was that they were required to be set to the locked mode only when the storage unit is at the desired location along the track. One example of structure such as this is Peterman, U.S. Pat. No. 4,523,794, which shows a locking mechanism used in conjunction with a handwheel by which the storage unit is moved along tracks on the floor. While the locking mechanism there disclosed operates very well, because of the details of the structure it is limited to use with the handwheel, besides the other disadvantages mentioned above. Another disadvantage of this type of locking mechanism is that it locks the storage unit against movement in both directions. Once the mechanism is engaged, it is not possible to move the storage unit in either direction. The necessity of always unlocking the storage unit before moving it and then re-locking it at the new location may be inconvenient and undesirable, particularly if only small increments of motion are required.

Another locking mechanism is shown in Peterman, U.S. Pat. No. 4,607,896. This mechanism includes a toothed rack positioned along the track on which the mobile storage unit moves. Again this arrangement is very effective in conjunction with the structure disclosed there, because it does not require a handwheel as indicated with respect to the earlier invention, and because even when engaged to prevent movement in one direction it permits movement in the other. But it is disclosed to be engaged by action of a lock and key. In certain instances it may be more convenient to have a lock mechanism that engages automatically, without any need for direct intervention or intentional action by a user.

In both of the above instances, the fact that the lock is not engaged automatically means that it might not be used, either due to inadvertence or inattention, or intentionally due to the inconvenience of using the lock. When the lock is not used, clearly, the effectiveness is lost.

This invention relates to improvements to the locking mechanisms described above, and to solutions to some of the problems raised or not solved thereby.

SUMMARY OF THE INVENTION

The present invention provides a locking mechanism for a mobile storage system having at least one movable storage unit for storing material and movable along a path. It is assumed that either a facing wall, a stationary storage unit, or another movable storage unit, is positioned on the path. The movable storage unit includes path wheels supporting the unit for easy movement along the path, and drive means for driving the path wheels both toward the facing storage unit or wall and away therefrom. An aisle can thus be opened and closed between the facing storage unit or wall and the movable storage unit by movement of the movable unit. The locking mechanism provided by the invention automatically locks a movable storage unit from movement in one direction, while permitting movement in the opposite direction. The purpose of the locking mechanism is to prevent accidental closing of the aisle formed by the movement of the storage unit.

The invention provides for binding means shiftable between a binding state, for permitting movement of the movable storage unit away from the facing storage unit or wall but by friction alone preventing movement toward the facing storage unit or wall, and a non-binding state, permitting movement of the unit toward the facing storage unit or wall. Shifting means are provided for shifting, due to the movable storage unit having moved away from the facing storage unit or wall a predetermined distance, the binding means from the non-binding state to the binding state. Means are also provided for resetting the binding means to the non-binding state, so that the binding means permits movement of the mobile storage unit toward the facing storage unit or wall. The shifting means includes a sensor or bar biased toward the facing storage unit or wall, and means on the mobile storage unit for co-acting with the bar to shift the binding means from its non-binding state to its binding state due to the movable storage unit having moved away from the facing storage unit or wall by the predetermined distance referred to above, that is, when the bar loses contact with the facing storage unit or wall. The binding means includes a binding block spaced apart from a clutch wheel and positioned tangential to the periphery of the clutch wheel. A resilient binding wedge is shiftable between at least two positions. One position is an engaged position, where the wedge contacts both the clutch wheel and the binding block, preventing rotation in the direction corresponding to movement of the unit closing the aisle while permitting rotation in the opposite direction. The other position is a non-engaged position, where the binding wedge is not in contact with both the clutch wheel and the non-moving surface, permitting rotation of the clutch wheel in either direction. This binding wedge arrangement provides quiet operation compared to the ratcheting locking apparatus of the prior art. This quiet operation can be important in areas where background noise is low or non-existent.

Other objects and advantages of the invention will become apparent hereinafter.

DESCRIPTION OF THE PREFERRED EMBODIMENTS

Figure 1:
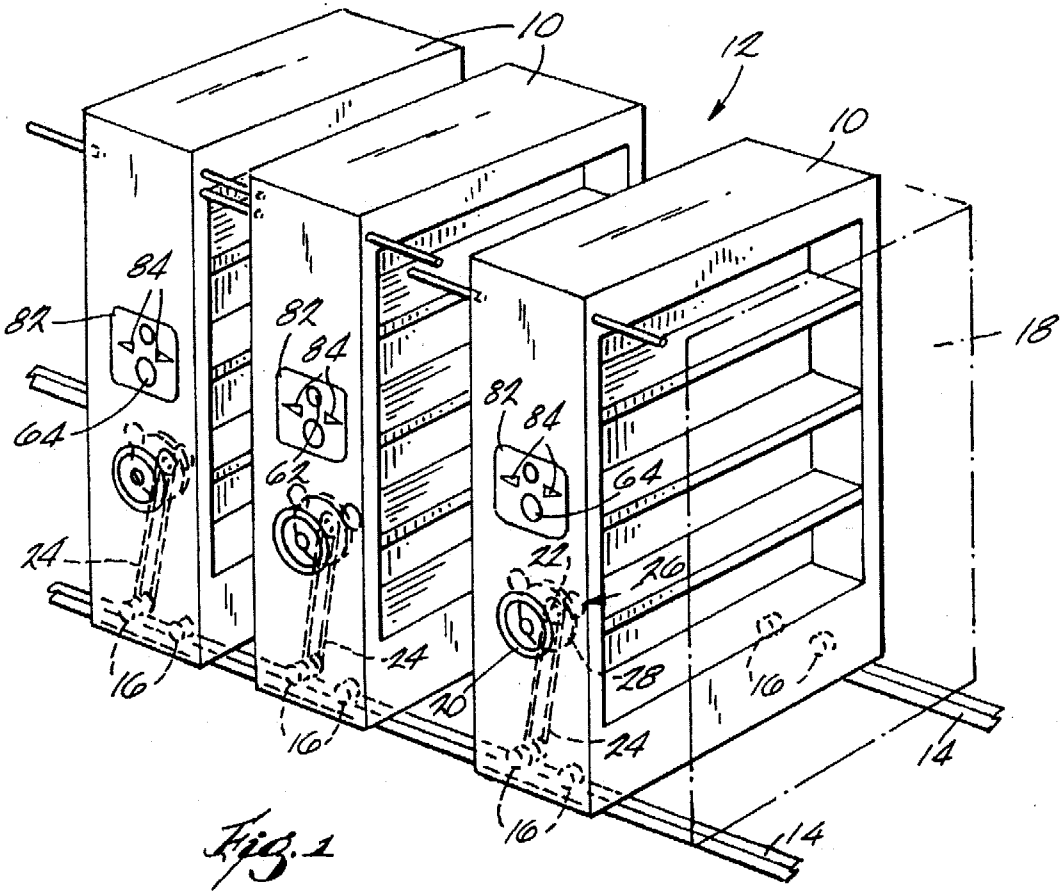
FIG. 1 is a perspective view of a mobile storage system, comprised of several movable storage units, constructed according to a preferred embodiment of the invention.

Referring now to FIG. 1, there is shown a number of movable storage units 10 each of which is a part of a mobile storage system 12. In this embodiment, each movable storage unit 10 is movable along a path defined by a track 14, such as by means of a number of wheels 16. The unit 10 can be moved along the track 14 by any suitable source of motion, including pushing by hand or by some externally powered means such as an electric motor. A blocking object 18, such as a facing wall, an opposing stationary storage unit, or another movable storage unit, is positioned on the path. An aisle can thus be opened and closed between the blocking object 18 and the movable storage unit 10 by the movement of the unit away from the object, for instance so that the shelves of the mobile storage unit 10 can be accessed. The invention is particularly well suited to a unit that is powered manually, such as by a handwheel 20 or corresponding hand lever system, connected for rotation with an upper sprocket 22. Manual power will be used where use of electrical energy as a power source is undesirable or unavailable, and the invention is particularly applicable there because the present aisle-locking invention requires no electrical energy. In this unit 10, power is transmitted in either direction between the upper sprocket 22 and the wheels 16 by a chain or belt 24.

According to the invention, binding means 26 are provided, shiftable between a binding state for permitting movement of the movable storage unit 10 away from the blocking object 18 to open the aisle, but frictionally preventing movement toward the blocking object to close the aisle, and a non-binding state permitting movement of the unit in either direction. In the embodiment shown in the drawing figures, and particularly referring to FIGS. 2, 5 and 6, the binding means 26 includes a clutch wheel 28 mounted to the movable storage unit 10 and associated with sprocket 22 for rotation when the sprocket rotates, such as by mounting the clutch wheel on the same shaft as the sprocket. Thus when the wheels 14 are rotated, such as by rotating the handwheel 20 or by moving or applying force to the movable storage unit 10 directly, the clutch wheel 28 rotates in the same direction and possibly at the same number of revolutions per minute as the upper sprocket 22. Hence this invention may also be applied to a movable storage unit that is moved merely by manually pulling or pushing directly on the movable storage unit.

Figure 2:
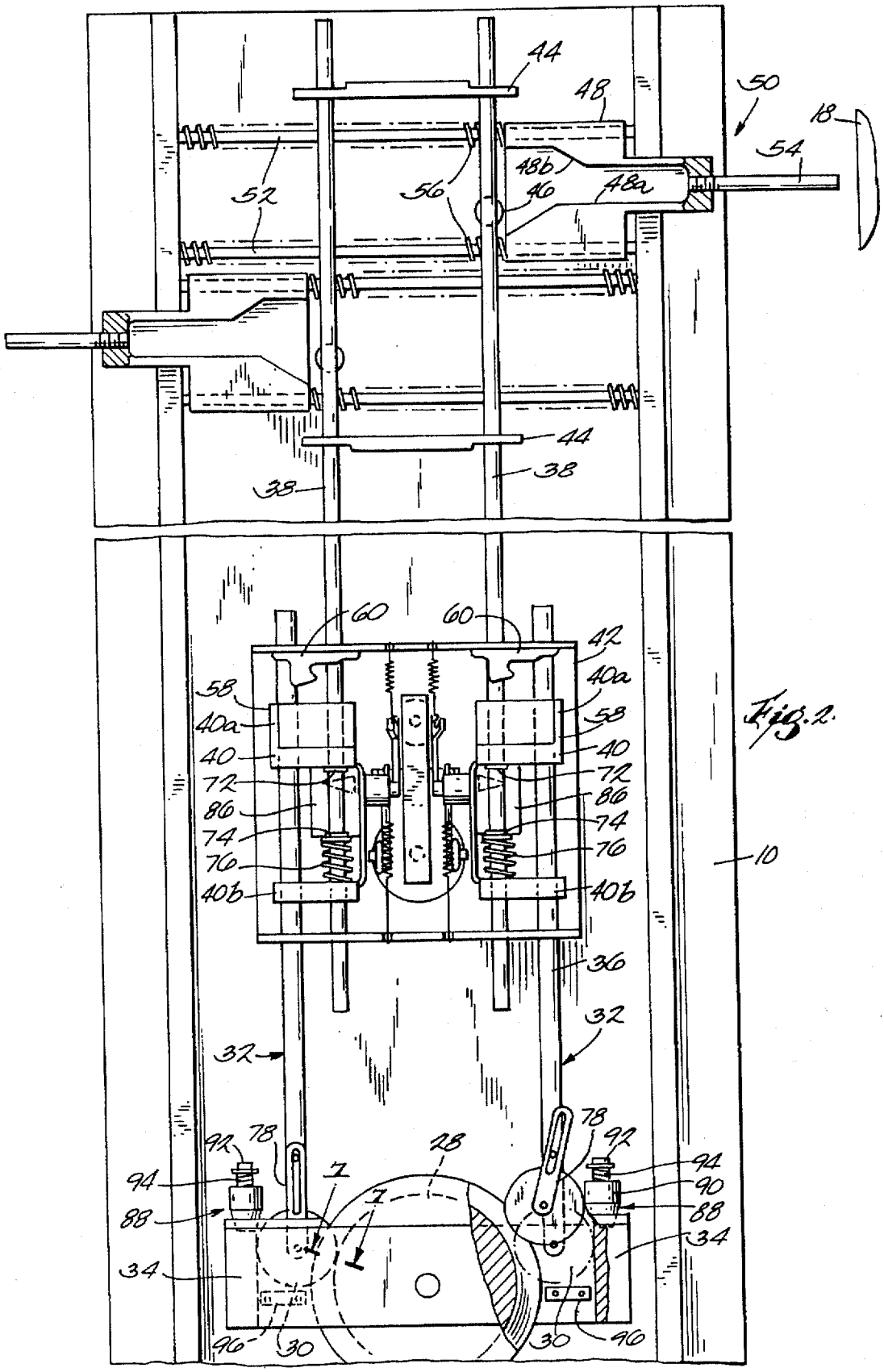
FIG. 2 is a front elevational view of a portion of one of the movable storage units shown in FIG. 1, showing one of the binding wheels in a relatively high-force engaged position, and the other binding wheel in a low-force engaged position.
Figure 5:
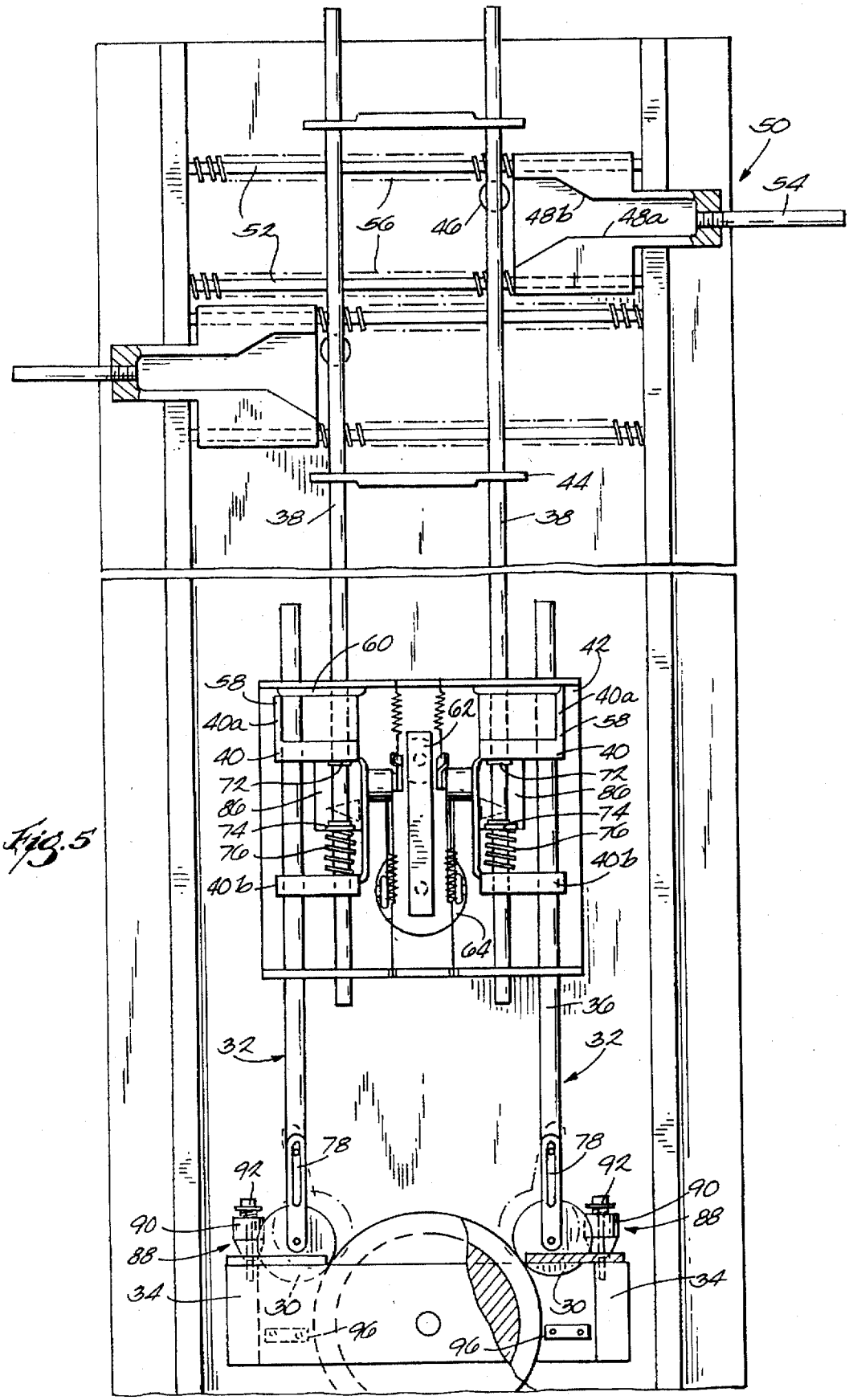
FIG. 5 is a front elevational view of a portion of the movable storage unit shown in FIG. 2, with both binding wheels latched in substantially zero-force position with the clutch wheel.
Figure 6:
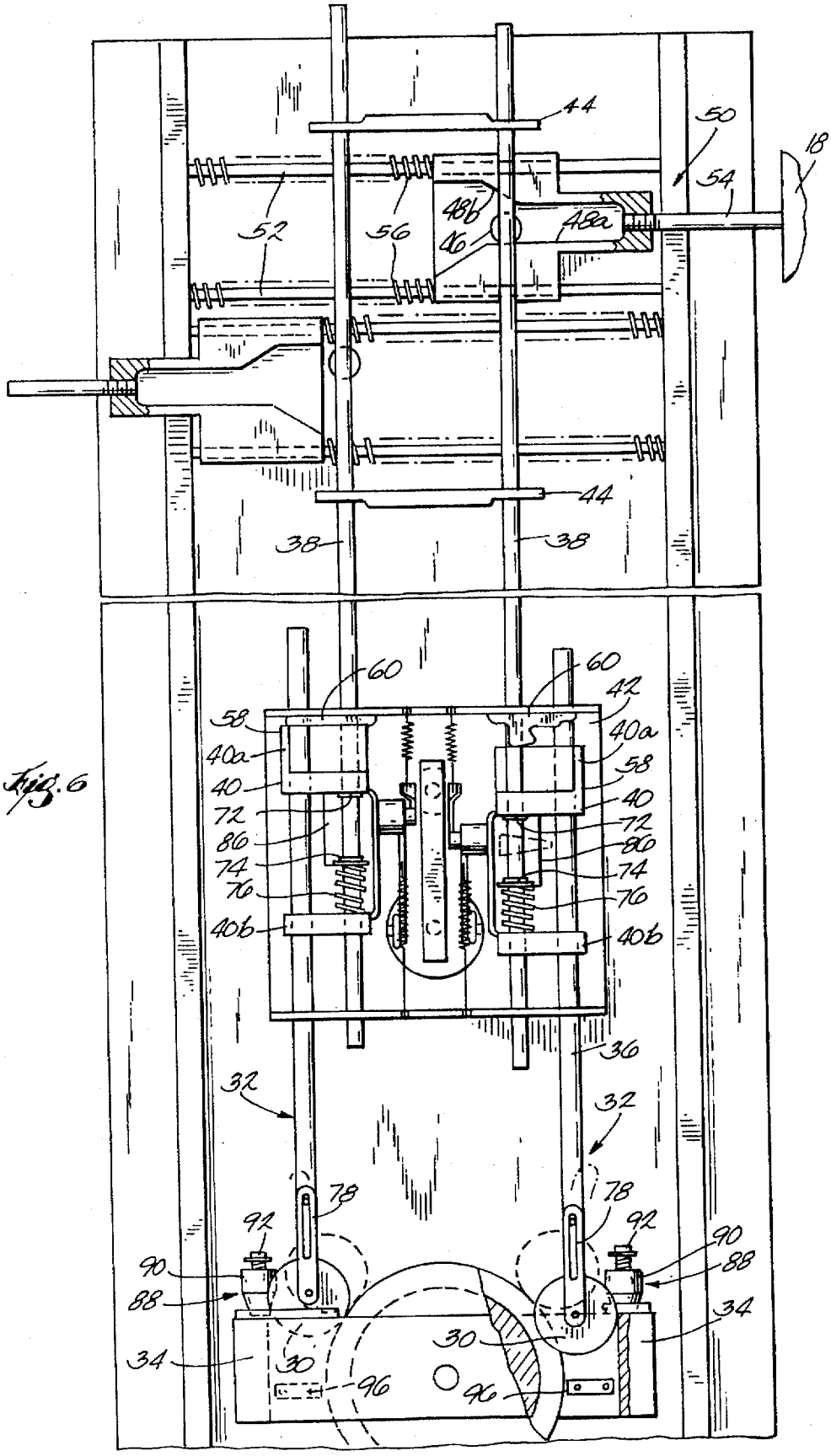
FIG. 6 is a front elevational view of a portion of the movable storage unit shown in FIG. 2, with one of the latches having been unlatched by the aisle sensor detecting that the blocking object has approached sufficiently closely.

The binding means 26 also includes at least one, and preferably two, binding wedges, each attached at one end of a respective connector rod 32, the details of which will be set forth shortly. In the most preferred embodiment as shown in the drawing figures, the binding wedges are embodied as binding wheels 30, each rotatably attached at one end of a respective connector rod 32. The final element of the binding means 26 is a stationary binding block 34, mounted to the movable storage unit 10, spaced apart from the clutch wheel 28 and positioned tangential to the periphery of the clutch wheel. That is, the binding block 34 is stationary with respect to the movable storage unit. Each binding wheel 30 may be positioned by the connector rod 32 so as to be in contact with both the clutch wheel 28 and the binding block 34, as shown in FIG. 2, (herein referred to as "a binding state" or "a binding position") or not in contact with both, that is, out of contact with either one or the other, as shown in FIGS. 5 and 6 (herein referred to as "a non-binding state" or "a non-binding position"). The binding wheel 30 is made of a resilient material, preferably polyurethane. When the binding wheel 30 is in binding position, as shown in FIG. 2, the binding wheel binds and frictionally precludes clutch wheel 28 from rotating toward the binding block 34. The clutch wheel 28 can freely rotate away from the binding block however. In this manner when the binding wheel is in binding position the movable storage unit 10 is permitted to move away from the blocking object 18, but precluded from movement toward the blocking object. If the binding wheel 30 is not in binding position, binding does not occur and rotation of the clutch wheel in either direction is available.

As indicated above, the binding wheel 30 is moved into and out of binding position by movement of the connector rod 32. According to the invention, the connector rod 32 may not be a single unitary part, but an assembly of several parts, all slidably mounted to the movable storage unit 10. The mounting of the connector rod 32 is such that only substantially vertical sliding motion is allowed. Each connector rod 32 can include a lower extension 36, an upper extension 38 and a junction bracket 40, where the lower extension and the upper extension are joined. Both the upper extension 38 and the lower extension 36 are connected to the movable storage unit 10 by being slidably mounted in a mounting bracket 42 affixed to the movable storage unit. Additional brackets, such as upper brackets 44, through which upper extension 38 is slidably mounted to the movable storage unit 10, are also preferably provided for additional support and stability. Upper extension 38 is provided with a cam follower 46 for interaction with a cam block 48, which is part of an aisle sensor 50. In the embodiment shown in the drawing figures, cam block 48 is slidably mounted to one or more, preferably two, horizontal bars 52, which in turn are affixed to the movable storage unit 10. Cam block 48 is thus slidable along bars 52 only substantially horizontally. Besides cam block 48, aisle sensor 50 includes an aisle sensor rod 54 affixed to the cam block, and protruding beyond the edge of the movable storage unit 10, preferably at a height above the floor greater than normal walking height, so as to avoid interference with users accessing the unit. The rod 54 is of sufficient length, and is positioned, so as to extend beyond the side of the movable storage unit 10 toward the blocking object 13. Cam block 48 is biased, such as by springs 56 about horizontal bars 52, so that rod 54 extends as far as possible beyond the edge of the movable storage unit 10. Cam block 48 includes lower cam surface **48*a* and upper cam surface 48*b*. Lower cam surface 48*a* begins with an ascending ramp, and then becomes flat. Upper cam surface 48*b*** begins flat, then proceeds into a descending ramp, and again becomes flat.

As has been described, the lower extension 36 and the upper extension 38 are joined at a junction bracket 40, together forming connector rod 32, which is slidably mounted in a mounting bracket 42. Junction bracket 40 also has attached to it a latch 58. A corresponding latch hook 60 is affixed to the mounting bracket 42, and positioned so as to engage with the latch 58. The particular latch 58 and latch hook 60 preferred by the inventors are commercially available from Southco, Inc., as the Model C3-203 latch assembly. This particular latch 58 is of the over-center pressure type, so that when it contacts the latch hook 60 with sufficient pressure, it engages, until sufficient pressure is exerted in the opposite direction, at which time the latch disengages or opens.

Figure 4:
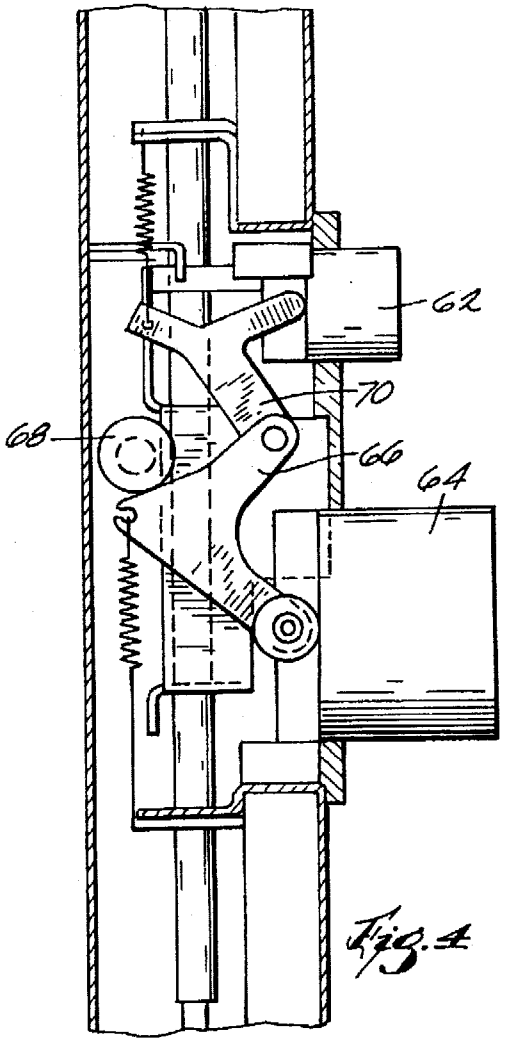
FIG. 4 is a side elevational view of the reset/latch assembly shown in FIG. 3.
Figure 3:
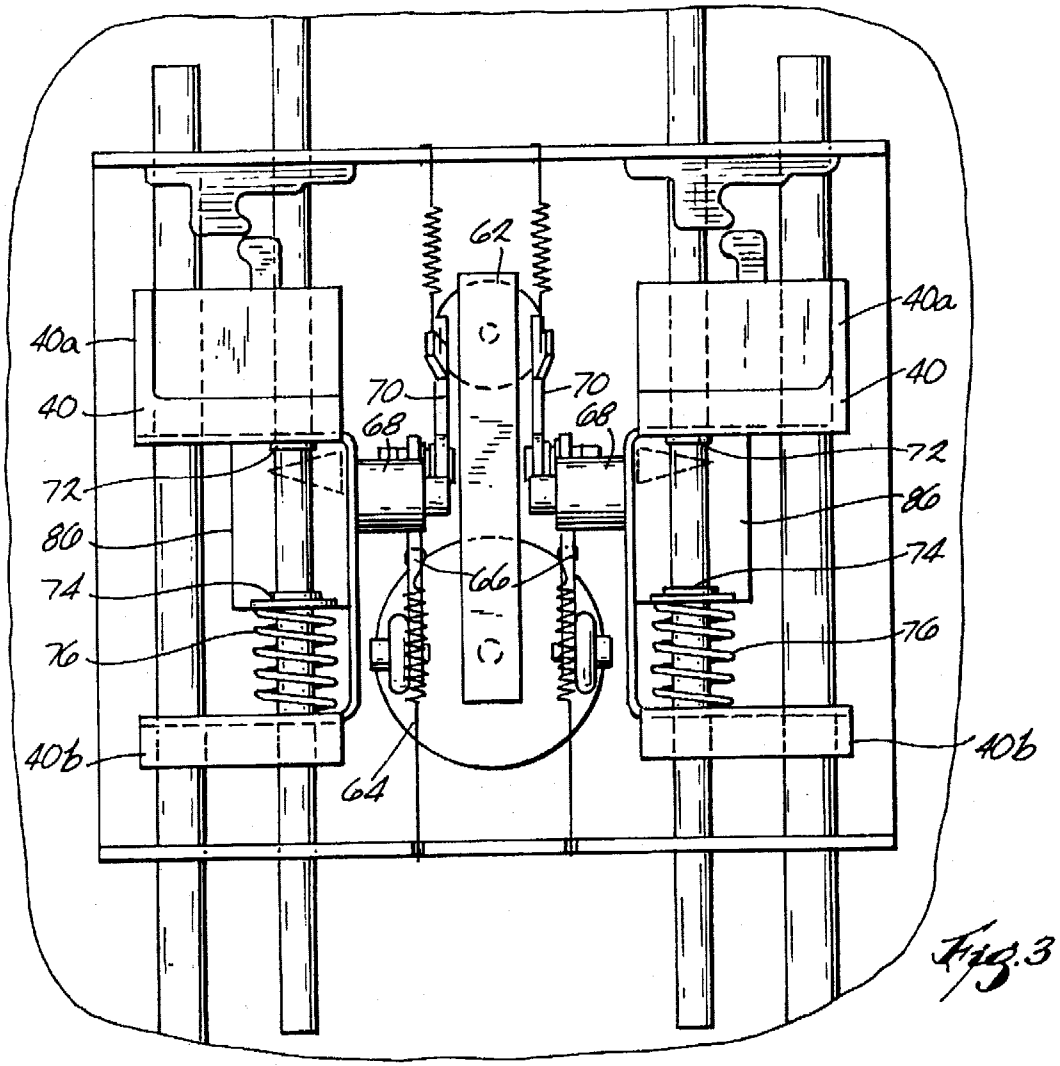
FIG. 3 is a front elevational view, on an enlarged scale, of a reset/latch assembly constructed according to a preferred embodiment of the invention, as shown in FIG. 1.

Referring now to FIGS. 3 and 4, in order to provide operator control over the functioning of the binding means 26, a lock button 62 and an unlock button 64 are provided, both extending through the side of the movable storage unit 10. It is an advantage to provide a single lock button and a single unlock button, as compared to prior art systems having a separate set of buttons for each side of the movable storage unit, because the single button arrangement is less confusing to users.

The function of the unlock button 64 is to disengage the binding wheel 30 from binding position, thus permitting the movable storage unit 10 to move. This function is accomplished by moving the connector rod 32 upward until the latch 58 and latch hook 60 engage together, so that the binding wheel 30 will be held disengaged, permitting the clutch wheel 28 to rotate towards the binding wheel. This upward movement is achieved by unlock button 64 acting on one end of an unlock link 66, the other end of the unlock link being pivotably attached to the movable storage unit 10 above the unlock button. A post 68 is affixed to the junction bracket 40, and positioned to be acted upon by the unlock link 66. Thus, when the unlock button 64 is pushed, the unlock link 66 rotates upward, pushing post 68 and therefore junction bracket 40 upward until the latch 58 engages with the latch hook 60.

The function of the lock button 62 is to move the connector rod 32 downward until the latch 58 and latch hook 60 disengage from each other, thereby enabling the binding wheel 30 to move into binding position if permitted by cam block 48 and cam follower 46. The lock button 62 acts on one end of a lock link 70, the other end of the lock link being pivotably attached to the movable storage unit 10 below the lock button. In the embodiment shown, the pivot axis for the unlock link 66 and the lock link 70 are the same. When the lock button 62 is pushed, the lock link 70 rotates downward, pushing post 68 and therefore junction bracket 40 downward until the latch 58 disengages from the latch hook 60. The post 68 may include a bushing, roller bearing or other bearing, to receive contact from the links 66, 70, and to facilitate movement.

The operation of the invention can be understood by considering and comparing the various drawing figures, in conjunction with the explanation which follows. FIG. 2 shows a binding wheel 30 in binding position, to prevent movement. In general, in the embodiment shown herein, each movable storage unit will have binding means 26 to prevent movement in each direction, and the parts and elements which prevent movement in one direction are of the same configuration as those which prevent movement in the opposite direction. That is, while generally each movable storage unit 10 will have only one clutch wheel 28, each will usually have two binding wheels 30, two connector rods 32, two junction brackets 40, two latches 58 and latch hooks 60, and two aisle sensors 50, one for each side of the movable storage unit. In the preferred embodiment, each movable storage unit 10 will have only one lock button 62 and one unlock button 64, but two lock links 70, two unlock links 66 and two posts 68, as the lock and unlock buttons are arranged to act on both respective links simultaneously.

As previously indicated, FIG. 2 shows both binding means 26 in binding positions, so that movement is retarded in either direction. Comparing that figure to FIG. 5, it can be seen that in FIG. 5 the unlock button 64 has been pushed, lifting the connector rods 32 so that the latches 58 and latch hooks 60 are engaged. The binding wheels 30 are thus held in non-binding position, so that movement of the movable storage unit in either direction is possible.

Moving on to FIG. 6, then, in that figure the movable storage unit 10 has moved sufficiently close to the blocking object 18 that the aisle sensor rod 54 on the right in the figure has contacted the blocking object. As the gap between the two has continued to close, the cam block 48 has been moved along the horizontal bars 52, compressing the springs 56. As that has happened, upper cam surface **48*b* has come into contact with cam follower 46, forcing the cam follower and indeed the entire connecting rod 32 downward, sufficiently to disengage latch 58 from latch hook 60. The cam follower 46 and connecting rod 32 are still supported by or resting on the lower cam surface 48*a*, so that binding wheel 30 is in non-binding position. If the movable storage unit 10 is later moved away from the blocking object 18, the binding wheel 30 will then be permitted to move down into binding position, as shown in FIG. 2**.

As can be seen in FIG. 6, when the blocking object 18 is close to the movable storage unit 10, the cam block 48 will be in a position that will prevent cam follower 46, and hence upper extension 38 of connecting rod 32, from moving upward when unlock button 64 is pushed. Because there is only one unlock button for both sides of the movable storage unit 10, in order to permit latching on the other side, the junction bracket 40 must be provided with the ability to move upward when the unlock button 64 is pushed. This ability is provided by the fact that the upper extension 38 is connected to the junction bracket 40 by means of an upper retaining ring 72, attached to the upper extension just below an upper portion **40*a* of the junction bracket, a lower retaining ring 74 attached to the upper extension just above a lower portion 40*b* of the junction bracket, and a spring 76 captured about the upper extension between the lower portion of the junction bracket and the lower retaining ring. That way, when the unlock button 64 is pushed when the movable storage unit 10 is in the position shown in FIG. 6, the junction bracket 40 moves upward, compressing the spring 76, without moving the upper extension 38 substantially upward. When the unlock button 64 is released, the spring 76 pushes the junction bracket 40 back downward to its original position. The spring 76 must provide enough force to release latch 58 from latch hook 60, in the not unlikely event that they would engage together when the unlock button 64 is pushed and the junction bracket 40** lifted.

Figure 7:
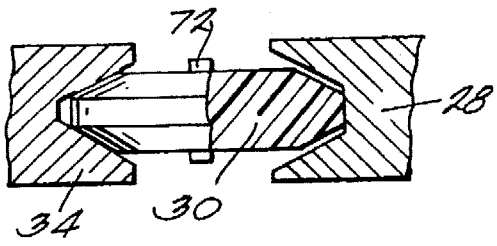
FIG. 7 is a cross sectional view of a binding wheel engaged with a clutch wheel and binding block, as shown in FIG. 2, taken generally along line 7—7 thereof.

As can be seen by comparing FIGS. 2 and 7, in the most preferred embodiment of the invention, the periphery of the clutch wheel 28 has a V-shaped opening in cross section, generally in the manner of a conventional V-belt pulley. Correspondingly, the periphery of the binding wheel 30 has a wedge-shaped cross section. Further, the surface presented to the binding wheel 30 by the binding block 34 also has a V-shaped opening when viewed in cross section or from the top or bottom. To provide the most friction, the wedge-shaped cross section of the periphery of the binding wheel 30 is or can be substantially complementary to the V-shaped opening cross section of the periphery of one or both of the clutch wheel 28 and the binding block 34. This improved friction between the binding wheel 30 and the clutch wheel 28 and/or binding block 34 further ensures that the binding wheel does indeed bind into the space between the clutch wheel and the binding block, effectively precluding movement of the movable storage unit in that direction.

In order to enhance the binding effect of binding wheel 30, the binding wheel is connected to the connector rod 32 by means of a slotted link 78. That is, the binding wheel 30 is journaled to the slotted link 78, which in turn is connected by a pin through a slot to the bottom end of the lower extension 36. This slotted link 78 permits binding wheel 30 to find its own best position for binding the clutch wheel 28, by permitting movement of the binding wheel in two dimensions, within limits, with respect to the connector rod 32. That is, the slot of slotted link 78 permits binding wheel 30 to move axially with respect the connector rod 32, and the pivotable attachment of the slotted link permits movement transversely.

As can be seen by comparing FIG. 1 and FIG. 4, the lock button 62 and the unlock button 64 protrude through an end panel 80 of the mobile storage unit 10, in association with a control inset 82, in order that the buttons can be accessed by a user. Also provided in association with control inset 82 is a status indicator arrow 84 for each side of the mobile storage unit 10, to indicate the status of the binding means 26, that is, whether the binding means is in binding position or non-binding position. In reality, status indicator arrows 84 are openings, or more preferably windows, into the end panel 80 of the mobile storage unit 10. As shown in FIGS. 2, 5 and 6, a status indicator panel 86 is attached to or formed as a part of the junction bracket 40, and generally positioned so as to line up behind the arrow 84. The face of the panel 86 that faces the status indicator arrow 84 is colored, such as with a colored sticker, with the upper appropriate portion, approximately one-third, being red, and the rest green. That way, when the binding wheel 30 is in a binding position as shown in FIG. 2, the panel 86 will be lowered so that the top portion is aligned with the arrow 84, and the arrow will appear red. When the binding wheel 30 is in non-binding position, either latched up as shown in FIG. 5, or unlatched but still supported as shown on the right side of FIG. 6, the panel 86 will be raised so that the lower portion is aligned with the arrow 84, and the arrow will appear green.

In order to improve and ensure the operability of the binding means 26, the most preferred embodiment of the invention provides a guide 88, attached to the binding block 34. The guide 88 includes a guide block 90. The upper portion of the guide block 90 is cylindrical in shape, and the lower portion has a frustoconical shape. A mounting pin 92 passes axially through the guide block 90, from top to bottom, and is affixed into the binding block 34. One suitable mounting pin 92 would be a shoulder bolt, threaded into the top surface of the binding block 34. A guide spring 94 is captured between the head of the mounting pin 92 and the top of the guide block 90. A stop block 96 is affixed below and between the periphery of the clutch wheel 28 and the binding block 34, so as to prevent the binding wheel 30 from proceeding entirely beyond, or even as far as, the center point of the clutch wheel.

The purpose of the guide 88 is to remove an inconvenience which can occur with this mechanically operated mobile storage system. It is not unusual that a movable storage unit when it reaches the end of its travel, carried by its own momentum, can compress bumpers between neighboring movable storage units, compress carriages of movable storage units that are slightly misaligned, and compress shelved objects that project beyond the shelving itself. When the motion stops and forces become equalized, the now-compressed mobile storage system can sometimes move the end unit, the one that has just reached the end of its travel, in the opposite direction. In prior art ratcheting mechanisms, the movable storage unit would in that situation lock up tight against the ratcheting mechanism, making it almost impossible to reset the mechanism. Even in the present invention, while the situation is nowhere near that severe and is really no more than an inconvenience, without the guide 88, this motion in the opposite direction can sometimes draw the binding wheel 30 into the gap between the clutch wheel 28 and binding block 34, that is, into binding position, to such an extent that it may become inconveniently difficult to push the unlock button 64 and pull the binding wheel out. Guide 88 removes this inconvenience by maintaining the binding wheel 30 most of the time in a low-force binding state or position, as shown in the right side of FIG. 2 in solid lines and the right side of FIG. 6, wherein the binding wheel 30 is between the clutch wheel 28 and the guide block 90 and the guide spring 94 may or may not be somewhat compressed. A high-force binding position, as shown on the left side of FIG. 2 and in phantom on the right side (as generally both sides will not be in a high-force binding position at the same time), is one wherein the binding wheel 30 has traveled well down into the gap between the clutch wheel 28 and the binding block 34. Generally the binding wheel would move into this high-force binding position only if the user tried to move the system in the opposite direction without first resetting the binding means. Most of the time, if not latched in a non-binding position by latch 58 and latch hook 60, the binding wheel 30 will be in the low-force binding position, and pushing the unlock button 64 will be substantially effortless.

Thus the invention provides a means for automatically preventing the accidental closure of an aisle, which means is easily resettable, all without any need whatsoever for electrical power.

While the apparatus hereinbefore described is effectively adapted to fulfill the aforesaid objects, it is to be understood that the invention is not intended to be limited to the specific preferred embodiment of mechanical automatic aisle lock set forth above. Rather, it is to be taken as including all reasonable equivalents within the scope of the following claims.

I claim:

1. In combination with a mobile storage system having at least one storage unit for storing material which is movable along a path, at least one blocking object on said path, and path wheels supporting the storage unit for movement along the path both toward and away from said blocking object;

a clutch wheel rotatably mounted to the movable storage unit and operatively connected to at least one of said path wheels for rotating with said at least one path wheel, so that rotation of the drive wheel in a first direction is associated with movement of the movable storage unit away from said blocking object, while rotation of the drive wheel in a second rotation direction is associated with movement of the movable storage unit toward said blocking object, said clutch wheel having a rotational axis and having a periphery located in a plane which is normal to said axis;

resilient binding means located in said plane, said binding means including a binding block spaced apart from the periphery of the clutch wheel and a resilient binding member shiftable between a binding state, permitting rotation of said clutch wheel in said first direction, only, wherein the binding member is in contact with both the periphery of said clutch wheel and said binding block whereby rotation of said clutch wheel in said first direction is permitted, thereby allowing movement of the movable storage unit away from the blocking object but preventing movement toward the blocking object, and a non-binding state, permitting rotation of said clutch wheel, and movement of said movable storage unit, in either direction; and shifting means for shifting said binding means from said non-binding state to said binding state.

2. The combination as recited in claim 1 further comprising reset means for resetting said binding means to said non-binding state, so that said binding means permits movement of said movable storage unit toward said blocking object.

3. The combination as recited in claim 1 wherein said shifting means includes a rod on said movable storage unit, and means for co-acting with said rod to shift said binding means from said non-binding state to said binding state due to said movable storage unit having moved away from said blocking object a predetermined distance thereby causing said coacting means to move said rod.

4. The system recited in claim 1 wherein said resilient binding member comprises a compressible wheel.

5. The combination as recited in claim 1 wherein the binding member comprises polyurethane.

6. A mobile storage system having at least one storage unit for storing material which is movable along a path, at least one blocking object on said path, and path wheels supporting the storage unit for movement along the path both toward and away from said blocking object comprising;

a clutch wheel rotatably mounted to the movable storage unit and mechanically connected to at least one of said path wheels for rotating with said at least one path wheel, so that rotation of the drive wheel in a first direction is associated with movement of the movable storage unit away from said blocking object, while rotation of the drive wheel in a second rotation direction is associated with movement of the movable storage unit toward said blocking object;

binding means including a binding block spaced apart from the periphery of the clutch wheel and a binding wheel shiftable between a binding state, wherein the binding wheel is in contact with both the periphery of said clutch wheel and said binding block whereby rotation of said clutch wheel in said first direction is permitted, allowing movement of the movable storage unit away from the blocking object, but preventing movement toward the blocking object, and a non-binding state, wherein rotation of said clutch wheel, and movement of said movable storage unit, in either direction is enabled; and shifting means for shifting said binding means from said non-binding state to said binding state and wherein the periphery of said clutch wheel is provided with a V-shaped concave circumferential groove, and the periphery of the binding wheel is convex and wedge-shaped in cross section.

7. The combination as recited in claim 2 wherein the wedge-shaped cross section of the periphery of the binding wheel and the V-shape groove of the periphery of the clutch wheel are substantially complementary.

8. The combination as recited in claim 6 further comprising a guide block attached to the binding block, biased toward the binding block, and positioned with respect to the clutch wheel and binding block so as to provide the binding wheel with a low-force binding state, intermediate said binding state and said non-binding state.

9. A mobile storage system having at least one movable storage unit for storing material and adapted to reeve along a path, at least one blocking object on said path, path wheels supporting the movable storage unit for movement along the path, and a clutch wheel for rotating with the path wheels as the movable storage unit moves toward and away from the blocking object comprising;

an apparatus for automatically preventing movement of the movable storage unit toward the blocking object subsequent to movement of said movable storage unit a predetermined distance away from the blocking object, said apparatus comprising:

a binding block spaced apart from the clutch wheel and coplanar therewith; and a resilient binding wheel, shiftable between an engaged position wherein the binding wheel is in contact with both the periphery of the clutch wheel and the binding block, whereby rotation of said clutch wheel in a first direction is permitted, allowing movement of the movable storage unit away from the blocking object, but preventing movement toward the blocking object, and a non-engaged position wherein the binding wheel is not in contact with both the periphery of the clutch wheel and the binding block so that rotation of said clutch wheel, and movement of said movable storage unit, in either direction is enabled; and shifting means for shifting, due to said movable storage unit having moved away from said blocking object a predetermined distance, said binding wheel from said non-engaged position to said engaged position.

10. A system according to claim 9 further comprising means for resetting said wheel to said non-engaged position, so that said clutch wheel is permitted to rotate in a direction corresponding to movement of said movable storage unit toward said blocking object.

11. A system according to claim 9 wherein said shifting means includes a slidable rod, and means for co-acting with said rod to shift said binding wheel from said non-engaged position to said engaged position due to said movable storage unit having moved away from said blocking object said predetermined distance.

12. A System according to claim 9 wherein said shifting means includes a rod slidably mounted to said movable storage unit and biased toward said blocking object, and means for co-acting with said rod to shift said binding wheel from said non-engaged position to said engaged position due to said movable storage unit having moved far enough away from said blocking object that said rod loses contact with said blocking object.

13. A system according to claim 9 further comprising a guide block attached to the binding block, biased toward the binding block, and positioned with respect to the clutch wheel and binding block so as to provide the binding wheel with a low-force binding state, intermediate said binding state and said non-binding state.

14. An aisle locking device for application to a mobile storage system having at least one movable storage unit for storing material and adapted to be movable along a path, at least one blocking object on said path, and path wheels supporting the movable storage unit for movement along the path toward and away from said blocking object, said locking device comprising:

a resilient binding wheel shiftable between a binding state for permitting movement of a movable storage unit away from a blocking object but preventing movement toward the blocking object and a non-binding state permitting movement of said unit in either direction;

a clutch wheel carried by said storage unit and operatively connected to at least one of said path wheels, said binding wheel and said clutch wheel having complementary surfaces binding means aligned in coplanar relationship with the periphery of the clutch wheel and engagable with said binding wheel to impede rotation thereof in said binding state and disengagable therefrom to effect said non-binding state;

shifting means for shifting said resilient binding wheel from said non-binding state to said binding state, and further comprising a guide block attached to said binding wheel and, biased toward said binding block, and positioned with respect to said clutch wheel and binding wheel so as to provide said binding wheel with a low-force binding state, intermediate said binding state and said non-binding state.

15. An aisle locking device as recited in claim 14 further comprising means for resetting said resilient binding wheel to said non-binding state, so that said resilient binding wheel permits movement of said movable storage unit toward said blocking object.

16. An aisle locking device as recited in claim 15 wherein said shifting means includes a rod on said movable storage unit, and means for co-acting with said rod to shift said resilient binding wheel from said non-binding state to said binding state due to said movable storage unit having engaged said blocking object and subsequently moved away from said blocking object said predetermined distance.

* * * * *

UNITED STATES PATENT AND TRADEMARK OFFICE

CERTIFICATE OF CORRECTION

PATENT NO. : 5,669,682

DATED : September 23, 1997

INVENTOR(S) : Steven L. Janson

It is certified that error appears in the above-identified patent and that said Letters Patent is hereby corrected as shown below:

Column 9, Line 44 After "claim" delete "2" and substitute --- 6 ---
Column 9, Line 55 Before "along" delete "reeve" and substitute --- move ---

Signed and Sealed this

Tenth Day of March, 1998

*Attest:*

*Attesting Officer*

BRUCE LEHMAN

*Commissioner of Patents and Trademarks*